US006138627A

United States Patent [19]

Iida

[11] Patent Number: 6,138,627

[45] Date of Patent: Oct. 31, 2000

[54] VALVE OPERATING ARRANGEMENT FOR ENGINE

[75] Inventor: Minoru Iida, Iwata, Japan

[73] Assignee: Yamaha Hatsudoki Kabushiki Kaisha, Iwata, Japan

[21] Appl. No.: 09/247,221

[22] Filed: Feb. 10, 1999

[30] Foreign Application Priority Data

Feb. 12, 1998 [JP] Japan ..... 10-030093

[51] Int. Cl.[7] ..... F01L 1/12; F01L 1/04

[52] U.S. Cl. ..... 123/90.6; 74/567

[58] Field of Search ..... 123/90.17, 90.6; 74/567

[56] References Cited

U.S. PATENT DOCUMENTS

| | | | |
|---|---|---|---|
| 3,574,304 | 4/1971 | Santi | 123/90.28 |
| 3,981,281 | 9/1976 | Deschler et al. | 123/90.6 |
| 4,459,946 | 7/1984 | Burandt | 123/90.16 |
| 5,287,840 | 2/1994 | Catanu et al. | 123/508 |
| 5,503,120 | 4/1996 | Shirey et al. | 123/90.12 |
| 5,647,310 | 7/1997 | Kimura | 123/90.6 |
| 5,687,680 | 11/1997 | Shichinohe et al. | 123/90.6 |
| 5,797,362 | 8/1998 | Taller | 123/90.17 |

*Primary Examiner*—Wellun Lo

*Attorney, Agent, or Firm*—Knobbe, Martens, Olson & Bear LLP

[57] ABSTRACT

Embodiments of valve operating mechanisms for operating the poppet valve of an internal combustion engine. Each embodiment includes a rotating cam member having a cam lobe surface engaged with a follower for actuating the poppet valve. The profile of the cam surface is such so that the absolute value of the jerk of the valve acceleration in the vicinity of maximum valve lift is smaller than the absolute value of the jerk of the valve in areas adjacent to the area of maximum valve lift. The load between the cam surface and the follower at the point of maximum lift is greater than the load during the time of at least one of the approach to maximum lift and the closing of the valve after the maximum lift because the tip of the nose of the cam has a greater effective radius than on the sides adjacent the tip. This reduces stress and permits greater engine speeds without valve float.

10 Claims, 10 Drawing Sheets

VALVE OPERATING ARRANGEMENT FOR ENGINE

BACKGROUND OF THE INVENTION

This invention relates to a valve operating mechanism for an engine and more particularly to an improved cam and follower profile for operating the intake and exhaust valves of an internal combustion engine.

In many forms of engines, the poppet vales are opened by a cam and follower mechanism that is comprised of a rotating cam which is carried on a cam shaft and which is driven in timed relationship to the engine output shaft. The cam generally operates the actuated valve through a follower type mechanism which may be of the thimble tappet type in connection with direct actuation or through a rocker arm in connection with indirect actuation. The valve is urged toward its closed position by some form of spring arrangement which frequently employs mechanical springs that act on the valve and/or rocker arm.

This type of mechanism has some disadvantages. First, because of the fact that the reciprocating movement of the valves is accomplished by translating a rotary motion into such motion, there is wear between the cam and follower surfaces. Also, the operation is such that inertial and other loading can cause a loss of contact between the cam lobe and its follower. This results in a condition known as "valve float". Valve float generally occurs at higher engine speeds and this condition generally is one of those factors that determine the maximum permissible engine speed.

When valve float occurs, substantial problems may arise and, therefore, the engine must be operated at low enough speeds so that as to avoid valve float. This reduces the potential maximum power output of the engine, as should be readily apparent.

Because the angular duration of crankshaft rotational movement during which the valves may be held open is limited, it is also desirable to control the valve opening in such a way that the valve is opened and closed rather rapidly and held in its maximum opened position for a fairly substantial duration of crankshaft rotation in order to improve the breathing capabilities to the engine. However, the stresses and wear aforenoted limit the maximum accelerations that can be enjoyed to open the valve and also, the conditions which are necessary to maintain the valve in its open position during engine running also can effect valve float.

These problems may be understood at least in part by reference to FIG. 1 which is a graphical view showing certain conditions during the opening and closing of a poppet type valve which may comprise either an intake valve or an exhaust valve for the engine. These curves are typical for the valve operation regardless of whether the valve is directly or indirectly operated.

FIG. 1 is a graphical view that shows the angular rotation of the cam shaft or cam on the ordinate and the degree of motion of the associated valve and certain characteristics of its motion such as its acceleration and rate of change of acceleration (jerk) on the abscissas. In this graphical view, it is assumed that the angular rotational velocity of the cam shaft and cam is constant as it generally is in an engine.

It will be seen that during the opening and closing cycle of the valve, the valve lift follows the curve Y. In connection with this, the cam lobe has a base circle or heel portion that has no lift and which has a constant radius $R_o$ that is centered on the cam shaft axis. The lift portion of the lobe is configured, as shown in curve Y so as to cause the valve to open and the opening follows a generally parabolic configuration of increase in lift amount after leaving the heal portion. As the opening continues, there is an inverse parabolic decrease in the lift amount until fully open. Closure occurs in a mirror image fashion with an inverse parabolic decrease in the lift amount upon initial closing. At the end of the closure, the decrease in lift amount again follows a parabolic curve whereupon the valve again is seated in its closed position.

This type of lift characteristic gives a valve acceleration component shown by the curve Y' that causes the valve acceleration to increase rapidly during the initial lift portion and then gradually decrease through the time when the valve is fully opened. At this time, the valve acceleration then turns negative and follows the a mirrored curve during the closing portion. This negative acceleration decreases rather abruptly when the tip of the ramp portion of the cam lobe is reached and continues to decelerate rapidly until the valve is fully closed.

The remaining curve of FIG. 1, which is labeled as Y" which represents the jerk forces on valve. These forces are related to the differential of the acceleration curve. As may be seen, there is a very rapidly increasing jerk force during the initial acceleration opening of the valve which falls off rather rapidly and then goes negative during the time when the valve is opening and begins to close in its parabolic curve configuration. The maximum negative jerk force occurs at the time when the valve is fully opened.

The jerk force is related to the actual bearing force between the cam surface and the follower or valve. Thus, when this value is low, there is a condition when there becomes a likelihood that the valve and/or follower will not follow the motion of the cam and cause the valve floating problem which is clearly undesirable.

The actual loading on the cam surface is the sum of the load expressed by action of the valve spring and the inertial force expressed by the product of the inertial mass of the actuated components (valve, portion of the valve spring and follower) and the acceleration of these components.

The stress on the surfaces of the cam and follower is proportional to the load acting on the surfaces and their effective area. The area of the cam surface is related to the inverse proportion of the square root of its radius of curvature.

With conventional cam profiles, when running in the low and medium speed range where the rotational speed of the cam shaft is low and there is a small influence of the acceleration, the maximum stress occurs in the maximum lift portion of the cam profile where the resilient force of the spring acting on the cam surfaces is at a maximum. At this time, the valve spring is at its maximum compression or deflection. Thus, with a conventional engine as utilized in automotive practice operated under low and medium speeds, the high stresses tend to cause a greater amount of wear and decreases the life or durability of the valve mechanism.

In addition to the high stresses, particular under the low and medium speeds with conventional cam constructions, the configuration of the tip of the lobe portion also tends to promote or, said another way, increase the likelihood of valve float. The valve spring tends to create a force on the valve follower that urges it into contact with the cam nose. However, as seen in FIG. 1, the negative acceleration at this point tends to cause separation due to the initial forces and thus, the follow up behavior between the cam nose and the follower at high speed is sacrificed and valve float can occur.

It is, therefore, a principal object of this invention to provide an improved cam profile for operating the poppet valves of an engine wherein the stress on the cam lobe surface is reduced and the loading under maximum lift conditions between the cam and the follower is increased so as to avoid float and thus, permit operation at higher engine speeds.

It is, thus, the principal object of this invention to provide an improved cam profile for operating the valve of a reciprocating engine wherein the engine can be operated at higher speeds and also wherein durability of the valve components and specifically the cam and follower are improved.

SUMMARY OF THE INVENTION

This invention is adapted to be embodied in a valve operating mechanism for operating the poppet valve of an internal combustion engine. The valve operating mechanism includes a rotating cam member having a cam lobe surface adapted to be engaged by a follower for actuating the poppet valve. The profile of the cam surface is such so that the absolute value of the jerk of the valve acceleration in the vicinity of maximum valve lift is smaller than the absolute value of the jerk of the valve in areas adjacent to the area of maximum valve lift.

Another feature of the invention is adapted to be embodied in a valve actuating mechanism of the type described in the preceding paragraph. In accordance with this feature of the invention, the load between the cam surface and the follower at the point of maximum lift is greater than the load during the time of at least one of the approach to maximum lift and the closing of the valve after the maximum lift because the tip of the nose of the cam has a greater effective radius than on the sides adjacent the tip.

DETAILED DESCRIPTION OF THE PREFERRED EMBODIMENTS OF THE INVENTION

Figure 1:
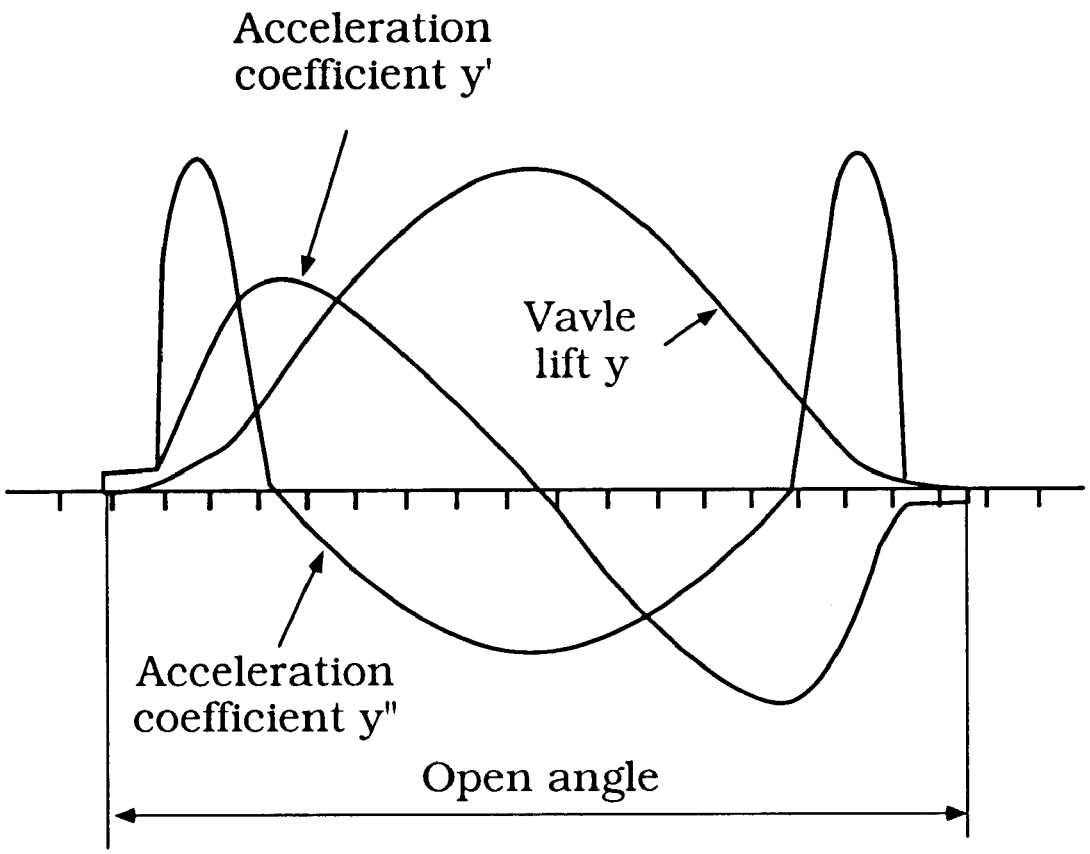
Figure 1 (Prior Art)
FIG. 1 is a graphical view showing the valve lift, valve acceleration and valve jerk characteristics in connection with the prior art type of construction.
Figure 2:
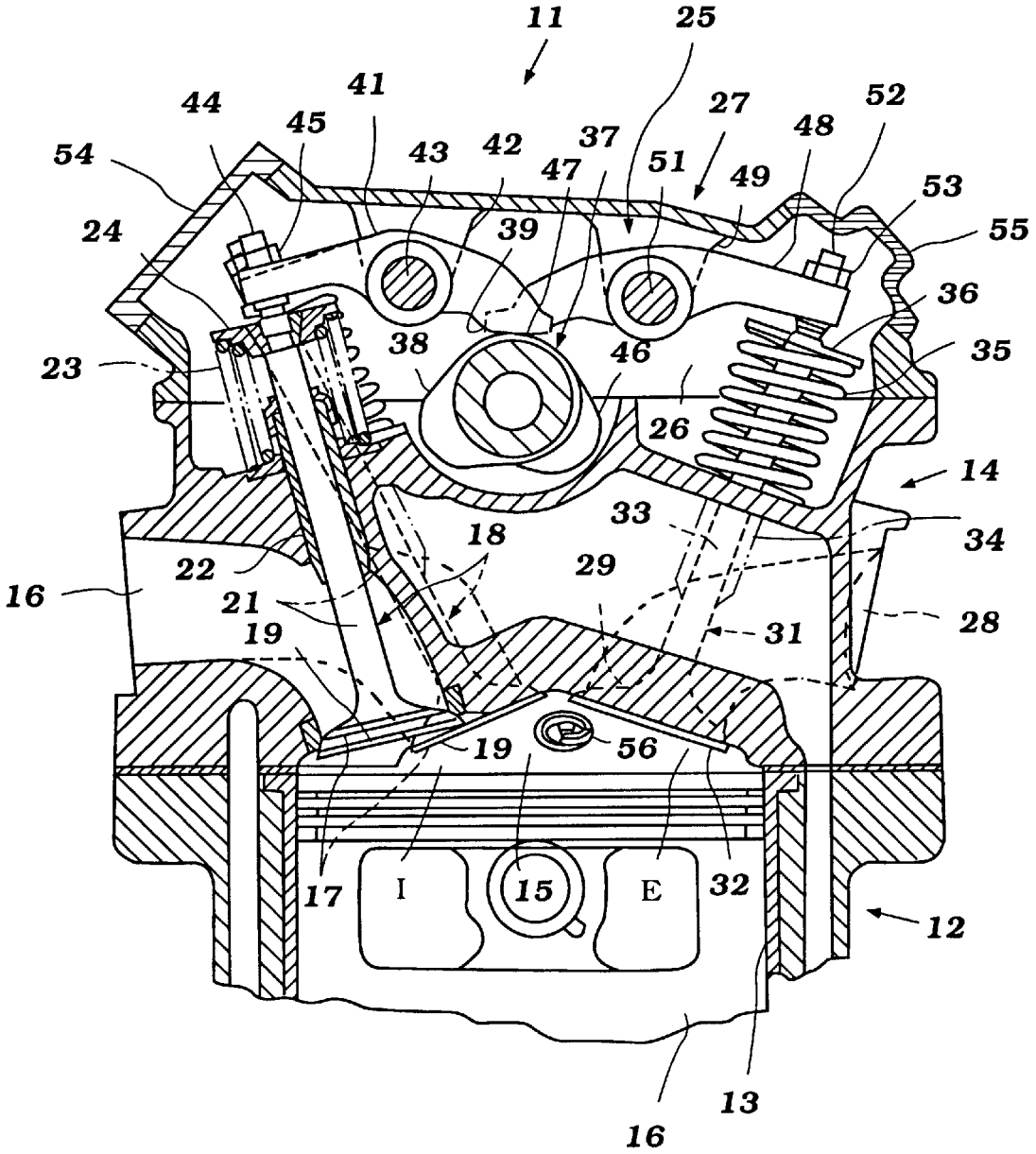
FIG. 2 is a partial cross-sectional view taken through the cylinder head of an internal combustion engine having a valve operating mechanism in accordance with a first type which can be employed with the invention.

Referring now in further detail to the drawings and now to FIG. 2, an internal combustion engine constructed in accordance with this embodiment of the invention is shown partially in cross-section through a single cylinder of the engine. The engine 11 is, in this embodiment, of the single overhead cam, five (5) valve per cylinder type. Because the invention deals primarily with the valve actuating mechanism, as should be apparent from the foregoing description, only the cylinder head portion of the engine and only that associated with a single cylinder need be shown to permit those skilled in the art to practice the invention.

It also should be understood that the invention deals primarily with the shape of the valve actuating lobes, particularly their nose portions, and their cooperation with the followers. Therefore, the following description of the components of the engine should be considered to be representative of any typical engine with which this feature may be used. Therefore, where components are not illustrated or not described fully, those skilled in the art should readily understand that any conventional or known structure can be employed.

The engine 11 includes a cylinder block assembly 12 which is formed with one or more cylinder banks each of which may be disposed at any respective angle to the other and which is formed with one or more cylinder bores 13. A cylinder head assembly, indicated generally by the reference numeral 14 is affixed to the cylinder block 12 and/or to each bank thereof in any known manner.

The cylinder head assembly 14 has individual recesses formed in the lower surface thereof, indicated generally by the reference numeral 15, which form in major part the combustion chambers of the engine. Each combustion chambers is completed by piston 16 that reciprocates in the respective cylinder bore 13 in a manner well known in the art. These piston 16 are connected through a suitable drive, such as connecting rods (not shown) to a crankshaft or output shaft of the engine 11 for causing its rotation in a manner well known in the art.

An induction system is provided for supplying an air charge to combustion chamber 15 generally on one side of a plane containing the axis of the cylinder bore 13. This side of the cylinder head being indicated by the identification "I". This induction system includes an intake passage arrangement 16 which is comprised of a common inlet that terminates in three intake valve seats 17 formed in the cylinder head recess 15 and in communication with the combustion chamber formed thereby.

Poppet type intake valves 18 have head portions 19 that cooperate with these valve seats 17 to control the flow therethrough. These poppet type valves 18 have stem portions 21 that are slidably supported within valve guides 22 formed in the cylinder head assembly 14.

Coil compression springs 23 encircle these valve stems 21 and engage keeper retainer assemblies 24 for urging the poppet type intake valves 18 to their closed positions. These poppet type valves are open by means of a valve actuating mechanism, indicated generally by the reference numeral 25, The valve actuating mechanism 25 is located in major part within a cam chamber 26 formed by the cylinder head assembly 14 and closed by a valve cover 27 thereof. This structure will be described in more detail shortly.

On the opposite side of the cylinder bore axis plane from the intake side I is formed an exhaust side E. This exhaust side E includes a pair of exhaust passages 28 formed in the cylinder head assembly 14. These exhaust passages initiate at valve seats 29 formed in the cylinder head recess 15 and are valved by means of poppet type exhaust valves 31. Like the intake valves 18, the exhaust valves 31 have head portions 32 that valve the valve seats 29. Stem portions 33 are supported within valve guides 34.

Coil spring assemblies 35 engage the cylinder head assembly 14 and keep a retainer assembly 36 affixed to the upper end of the valve stems 33 for urging the exhaust valves 31 to their closed positions.

The valve actuating mechanism 25 includes a single cam shaft 37 that is rotatably journaled in a suitable manner in the cylinder head assembly 14 in the valve chamber 26. This cam shaft 37 is driven at one-half engine output shaft speed by any suitable timing drive.

The cam shaft 37 has a series of intake cam lobes 38 which cooperate with follower portions 39 of intake rocker arms 41. The intake rocker arms 41 are journaled in the cam cover 27 on bosses thereof 42 by means of an intake rocker arm shaft 43.

Each rocker arm 41 carries an adjusting screw 44 that engages a stem portion 21 of the respective intake valve 18 for opening them in a known manner. The adjusting screws 44 are locked in position by means of lock nuts 45.

In a similar manner, the cam shaft 37 has exhaust cam lobes 46 that are engaged with follower portions 47 of exhaust rocker arms 48. The exhaust rocker arms 48 are journaled also on the cam cover 27 in bosses thereof 49 on an exhaust rocker arm shaft 51.

The outer ends of the exhaust rocker arms 48 carry adjusting screws 52 that are engaged with the exhaust valve stems 33 for operating them in a known manner. The adjusted position of the screws 52 is held by lock nuts 53 in a well known manner.

The cam cover 27 has access openings juxtaposed to the adjusting screws 44 and 52, respectively that are closed by removable covers 54 and 55 for adjustment of the valve lash in a known manner.

A spark plug 56 is mounted in the cylinder head assembly 14 with its gap extending into the recess 15 for firing the charge that is formed therein. The charge forming system may be of any known type.

As has been previously noted, this construction is generally of a conventional type but for the configuration of the cam lobes 38 and 46. This configuration will be described shortly by reference to FIGS. 4–8.

The engine 11 of the embodiment of FIG. 2 is of the single overhead cam type and operates the respective poppet valves through rocker arms. The invention also is capable of use with directly actuated valve mechanisms and FIG. 3 shows such an embodiment.

Figure 3:
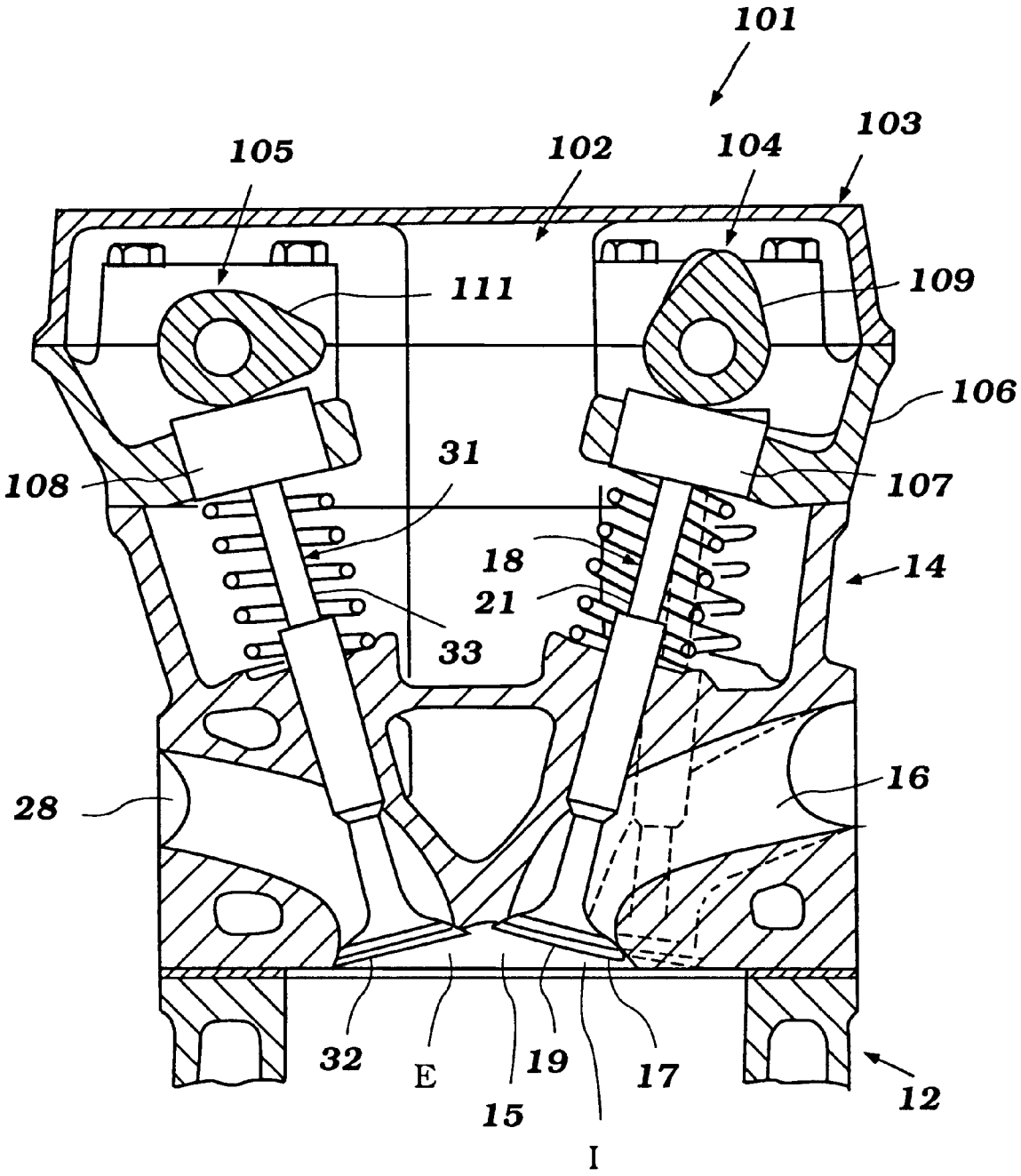
FIG. 3 is a cross-sectional view, in part similar to FIG. 2, and shows another valve actuating type of mechanism with which the invention can be practiced.

FIG. 3 illustrates the same basic portion of the engine as shown in FIG. 2. However, the engine, identified generally by the reference numeral 101 in this figure is of the twin overhead cam shaft type. The basic structure of the cylinder head and valves is the same as the previously described embodiment. In this embodiment, however, the intake and exhaust sides are reversed. Therefore, where components of this embodiment are the same or substantially the same as those previously described, they have been identified by the same reference numerals and will be described again only insofar as to understand how they are utilized in this embodiment.

In this embodiment, the cylinder head assembly 14 forms a cam chamber 102 that is closed by a cam cover 103. A pair of overhead mounted cam shafts consisting of an intake cam shaft 104 and an exhaust cam shaft 105 are rotatably journaled in a cam carrier 106 which forms a further component of the cylinder head assembly 14 in this embodiment.

This cam carrier 106 slidably supports a series of intake tappets 107 that cooperate with the stems of the intake valves 18 for their actuation. Also, a set of exhaust tappets 108 are also slidably supported in the cam carrier 106 and are associated with the stems of the exhaust valves 31 for their actuation. Each of the cam shafts 104 and 105 have respective cam lobes 109 and 111 that cooperate with the respective tappets 107 and 108 for opening the intake valves 18 and exhaust valves 31, respectively in a manner well known in the art.

As with the embodiment of FIG. 2, the basic construction of the engine 101 may be of any known type. The invention deals with the shape of the cam lobes 109 and 111, and that configuration will now be described by reference to FIGS. 4–8. In these figures, the camshafts are identified by the reference numerals applied in FIG. 3. It should be noted, however, that the same considerations can be applied with the camshaft that operate the valves through rocker arms. Those skilled in the art will readily understand how this can be done.

Figure 4:
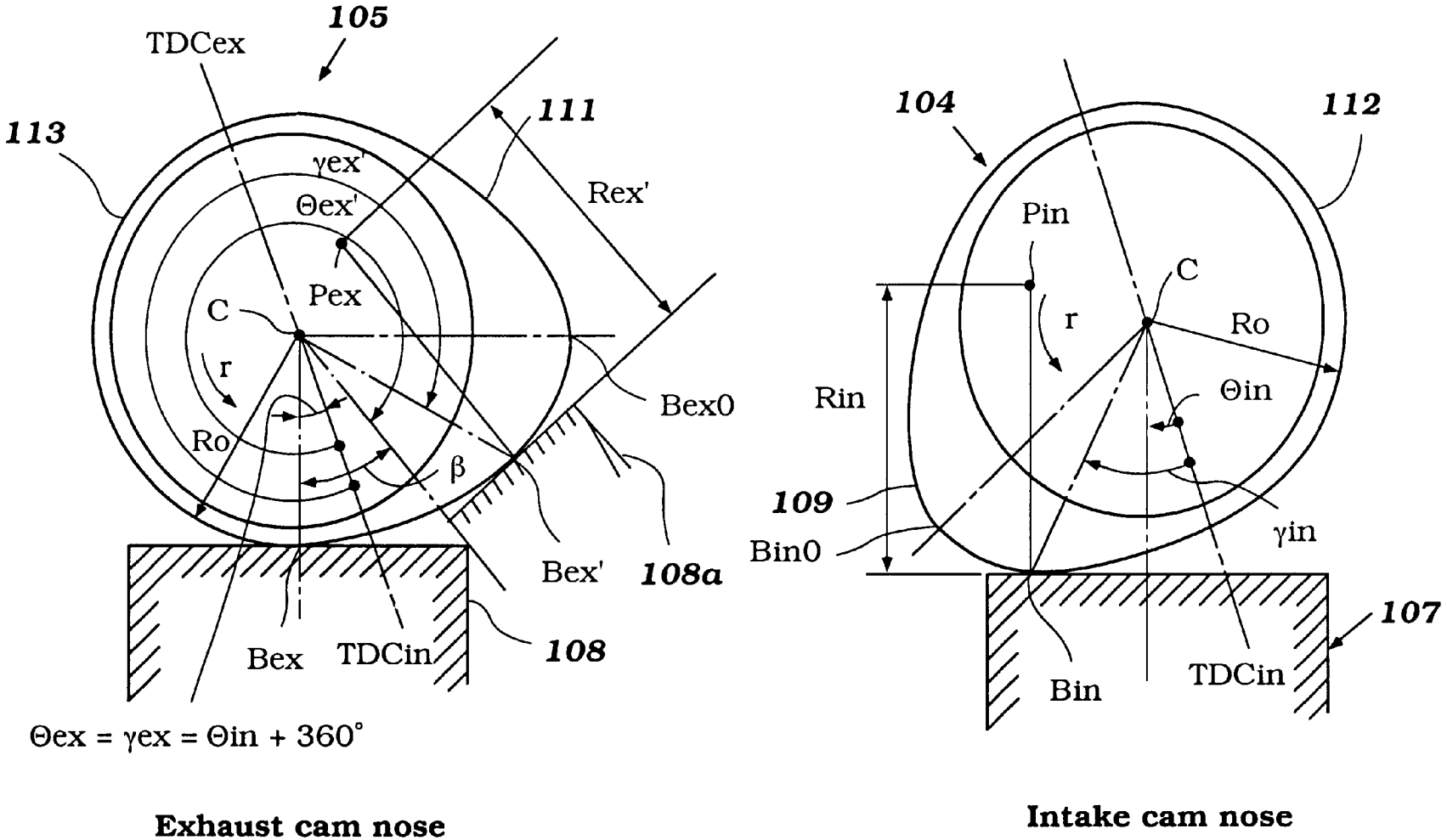
FIG. 4 is an enlarged view looking in the same direction as FIG. 3 and shows the intake and exhaust valve actuating mechanisms in order to explain the principal of the invention.

The direction of rotation of the camshafts 104 and 105 is indicated in FIG. 4 by the arrows r. In addition to the lobe portions 109 and 111 of the intake and exhaust cams 104 and 105, each also has a heal portion 112 and 113, respectively, which has a constant radius indicated at Ro, which in this embodiment, is the same for each camshaft. As will become apparent from the following description, the invention can be employed with engines where the intake and exhaust cam lobes are not the same configuration or same dimensions. For the ease of illustration, however, the initial embodiment assumes both intake and exhaust camshafts have the same lobe configuration.

Figure 5:
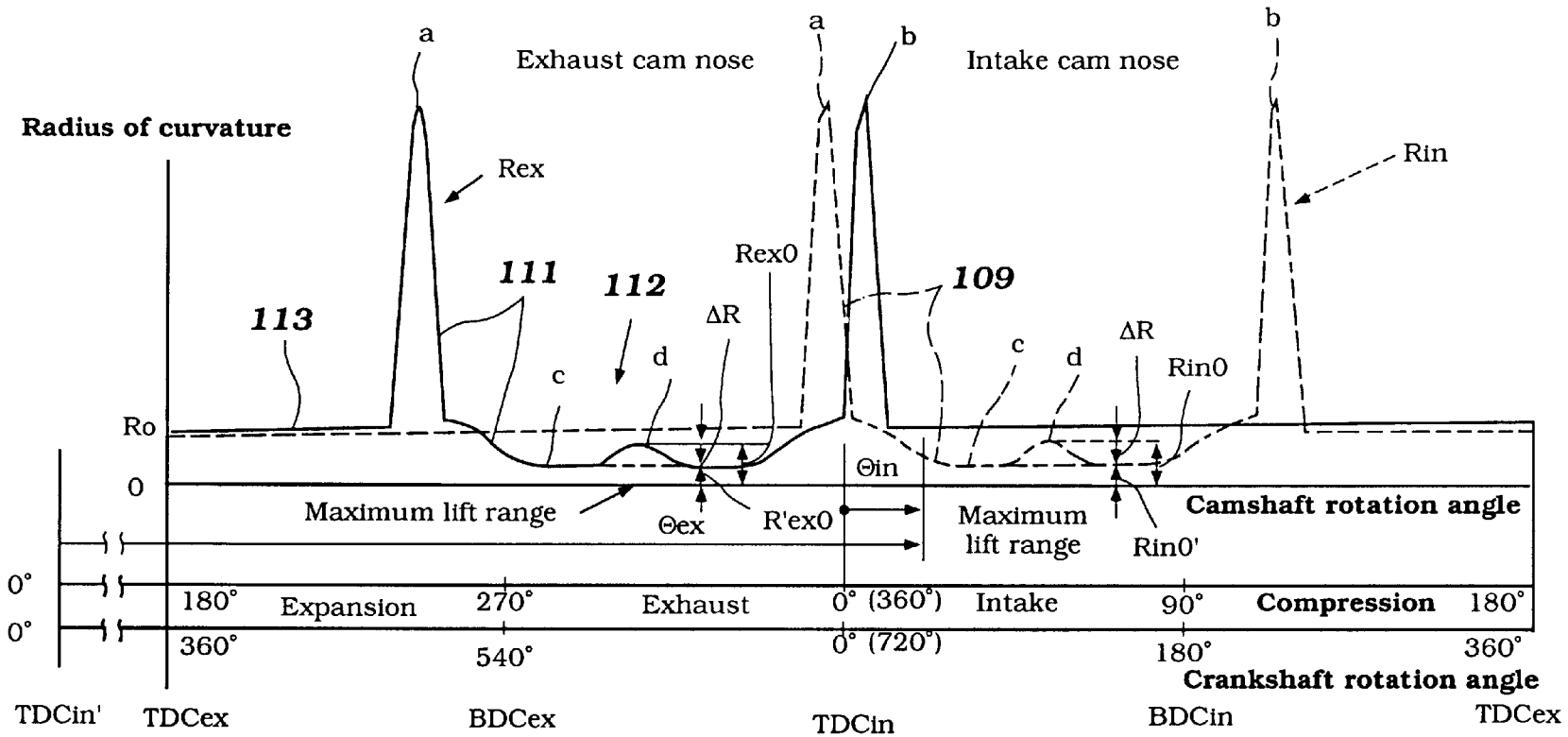
FIG. 5 is a timing diagram showing how the cam radius varies relative to rotational angle in accordance with the valve actuating mechanism incorporating the invention.
Figure 6:
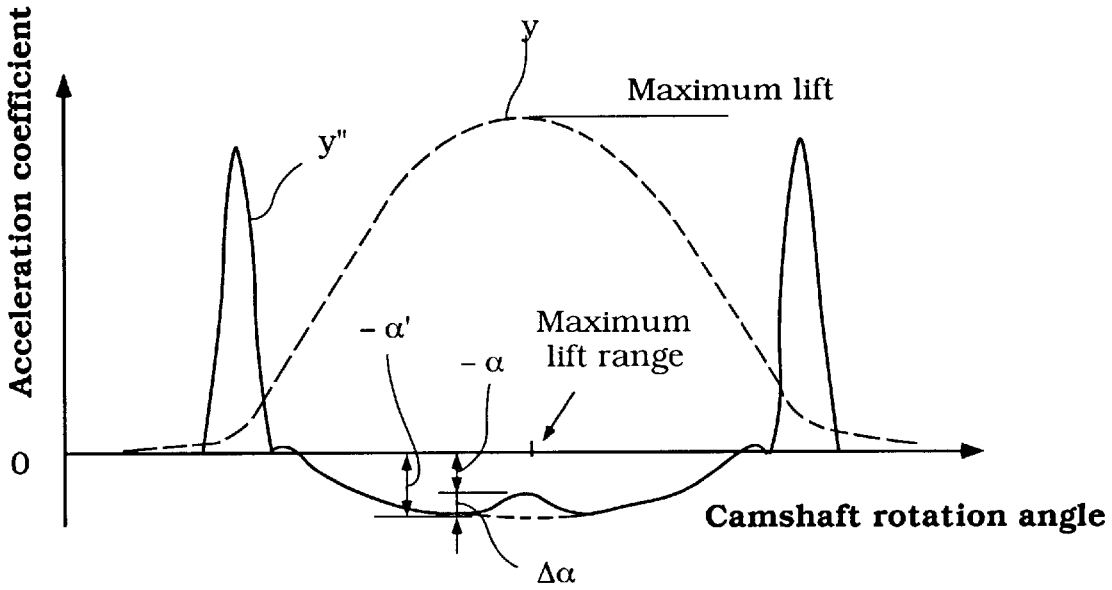
FIG. 6 is a graphical view showing how the valve lift and valve jerk vary in as a result of the cam configuration shown in FIG. 5.
Figure 7:
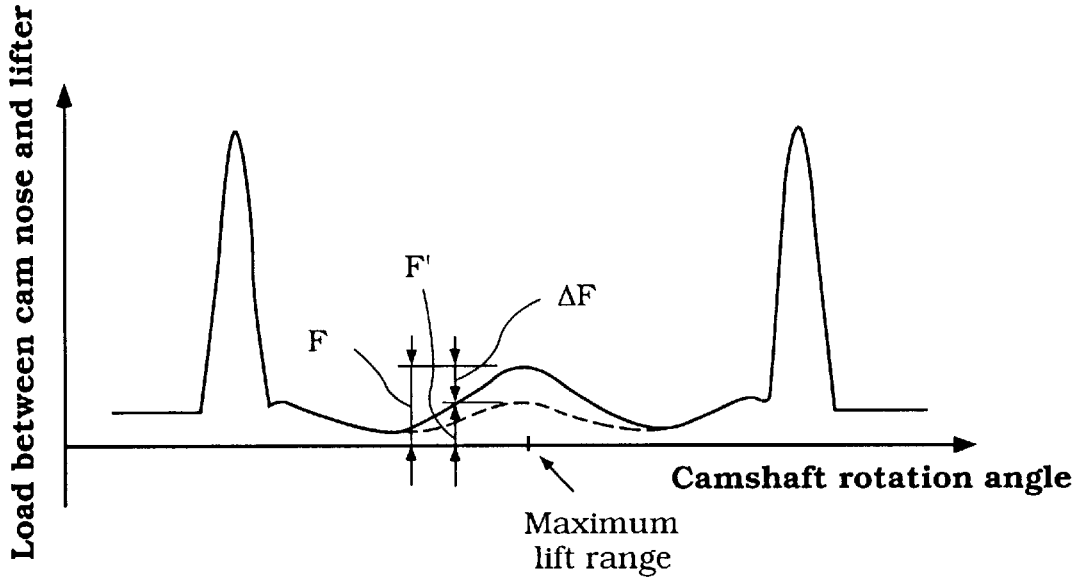
FIG. 7 is a graphical view showing how the load between the cam lobe and the follower varies in accordance with the invention.
Figure 8:
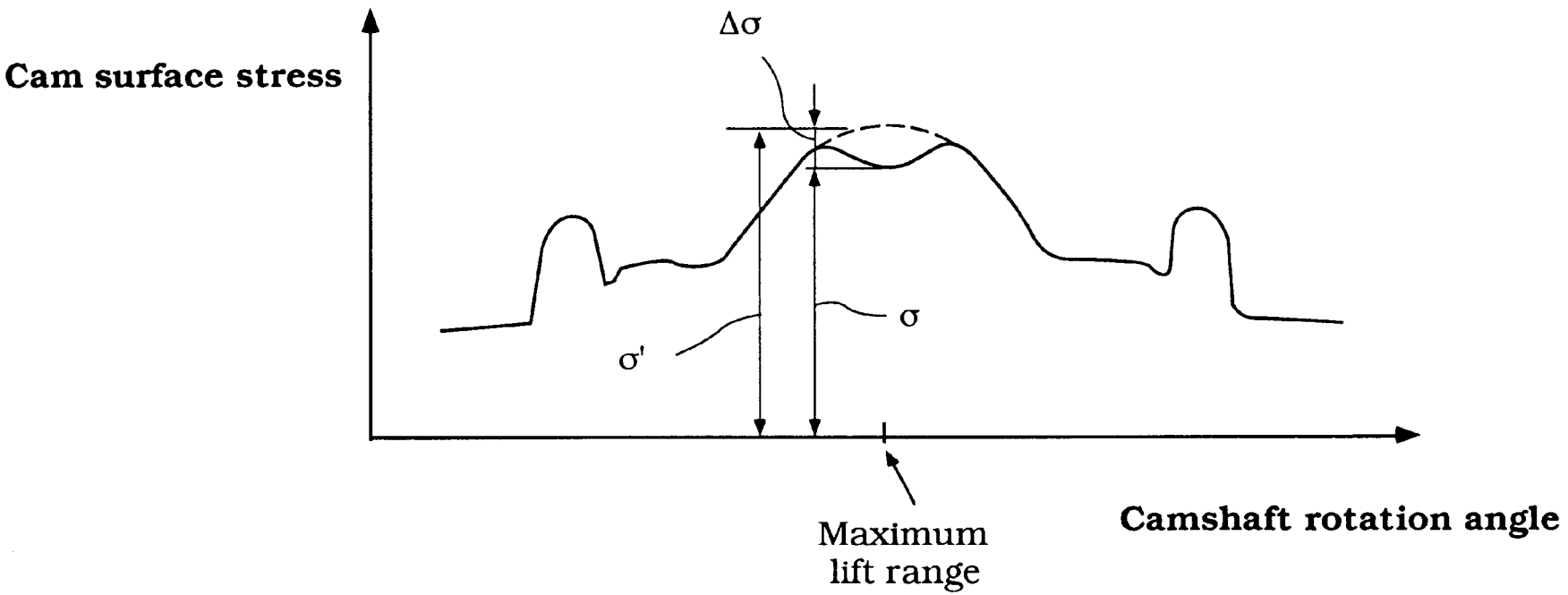
FIG. 8 is a graphical view showing the stress on the cam surface in accordance with the invention.

It should be remembered that the camshafts 104 and 105 are rotated at one half crankshaft speed. FIG. 5 is a view that shows the radius of curvature of the respective camshafts at all annular positions relative to the crankshaft angle and thus describes the profiles of the cams 109 and 111. FIG. 6 is a view that shows the lift and jerk associated with each camshaft due to these profiles. FIG. 7 is a view that shows the existing load between the cam nose and the respective tappet, and FIG. 8 is a view that shows the cam surface stress in relationship to rotational angle. The FIGS. 6–8 show only the lift portion of the curve, while FIG. 5 shows the complete rotation of the crankshaft.

The condition of the cam lobes relative to their respective tappets shown in FIG. 4 conforms to a position shown by the vertical line offset slightly to the center of FIG. 5 when the crankshaft has rotated through an angle θin from the top dead center position at the completion of the exhaust stroke and when the intake stroke has started. This top dead center position is indicated at TDCin to distinguish between the two top dead center conditions that occur during a complete cycle, bearing in mind the engines 101 and 11 operate on a four cycle principle.

As is conventional with most engine camshaft design, the top dead center position of the intake stroke, the intake valve has already begun to open and the exhaust valve is still partially open, but is closing. The point θin is chosen for illustration because it permits showing of the position of the intake camshaft after its lobe 109 has begun to lift the tappet 107 and the associated intake valves 18. This figure also shows the condition when the leading edge of the exhaust camshaft heal portion 113 is engaged with the exhaust tappet 108 and the exhaust valves 31 will be held in their closed position by their spring.

The radius Ro of the heal portions 112 and 113 of the intake and exhaust camshafts 104 and 105, respectively, is drawn from the axis of rotation of these camshafts indicated at C. However, when each cam rotates to its lift portion 109 and 111, respectively, the radii of curvature is not necessarily coincident with the axis of rotation of the camshafts C. Rather, the center of the curvature at a given point Bin or Bex', which radius is indicated at Pin or Pex, respectively, is shifted and the radius is also changed. The exhaust tappet 108 is rotated to the position 108*a* in the phantom view of this figure to show the corresponding condition of the exhaust cam shaft 105 and follower.

As with conventional practice, during the initial lift of each camshaft, the radius increases rather abruptly to the maximum radius indicated at "a" on the lift side and "b" on the closing side (FIG. 5), which are assumed to be the same in this embodiment, in order to achieve a fast opening of the respective valve. The radius then drops off rather abruptly and actually in the area approaching maximum lift, the radius may be less than that of the heal portion 112 or 113, respectively. Generally in the prior art constructions, this radius is held fixed throughout the nose portion of the curve of the cam lobes 109 and 111, respectively.

In accordance with the invention, however, when each camshaft is at its maximum lift portion, indicated at Bino and Bexo, a line through the camshaft axis C is perpendicular to the face of the respective tappet 107 and 108 and passes through its center. In accordance with the invention, as this position is reached, rather than holding a constant radius, the curvature radius is increased so that the radius Rino or Rexo differs from the conventional radius Rino' or Rexo' by an amount ΔR. This is shown by the point "d" on the curves in FIG. 5 which differs from the normal curvature "c" throughout the maximum lift range of a conventional camshaft. The effects of this will be described shortly.

As the crankshaft continues its rotation toward the end of the intake stroke, the intake valve is still held open for awhile and the intake camshaft lobe 109 is on the closing portion thereof. Again, the radius then increases abruptly so as to cause a more rapid final closure of the valve at sometime after bottom dead center on the intake stroke, indicated in FIG. 5 at BDCin. This is approximately after something more than 90° of camshaft rotation and more than 180° of crankshaft rotation.

The intake camshaft then closes during the compression stroke and is fully closed when the piston reaches top dead center, indicated at TDCex, at the completion of the compression stroke. The piston then moves downwardly after the spark plug has fired and the charge in the combustion chamber is burning so as to permit the expansion stroke to occur.

In accordance with conventional valve timing design, the exhaust valve is opened at a point before the piston reaches bottom dead center at the completion of the expansion stroke. Again, the exhaust camshaft lobe 111 is formed so that it has a rapidly increasing radial dimension for this initial opening and then as the maximum lift portion is approached, the radius is decreased and becomes less than that of the heal portion 113. This is something before 540° of crankshaft rotation and 270° of camshaft rotation.

At the maximum lift condition, when Bexo is perpendicular to the cam tappet surface 108, the radius Rex is made somewhat larger than the conventional so that Rexo is greater than the conventional radius Rexo' by the amount ΔR so as to provide a substantial reduction in jerk at this condition.

Here, there is a certain relationship determined from the cam shape and specifically θin and τin, that is, τin=f1(θin). The radius Rin is the function of both τin and θin in that Rin=f2(τin)=f2(f1(θin))=g1(θin). The function g1(θin) represents the data of radius of curvature shown in FIG. 4.

Therefore, once the data of Rin=g1(θin) is given, Rin=f2(τin) and τin=f1(θin) are determined. Thus the shape of the cam nose is determined. That is to say if it is assumed that $Z_{in}$ is the distance between the camshaft center C and the contact point Bin, and $Y_{in}$ is the distance between the camshaft center C and the lifter on the normal line directed from the camshaft center C to the lifter, once the radius of curvature $R_{in}$ (τin) is determined, $Z_{in}$(τin) for determining the geometric cam profile and $y_{in}$ (θin) for determining the valve lift amount relative to the camshaft rotation angle when the intake cam is rotated at a constant camshaft rotation angular velocity are determined. The cam lift curve of the intake cam nose is the distance $y_{in}$ between the camshaft center C and the lifter as mentioned. The same relationship also applies to the exhaust cam nose.

The net effect of this may be seen in FIG. 5 which superimposes the jerk curve on the lift curve. As may be seen, because of the increase in radius, there is a decrease in the amount of jerk indicated at Δa. Thus, the loading tending to separate the tappet from the cam lobe is substantially reduced and the engine speed can be substantially increased without the risk of valve float.

FIG. 7 shows the load F acting between the cam nose and the tappet, with the camshaft rotation angle as a parameter. The load F acting between the cam nose and the tappet is expressed as the sum of the load produced by the valve spring and the inertia force. The inertia force is the product of the acceleration and the inertia mass including the valve, the tappet, and part of the valve spring. In the vicinity of the maximum lift, since the jerk is negative, the inertia force is negative. The acceleration is the product of the jerk y" (in mm/rad$^2$) shown in FIG. 6 and the square of the actual camshaft rotation speed (in ωrad/sec), or $y''\times\omega^2$(mm/sec$^2$). That is to say, $F=k(y+y_O)+M\times y''\times\omega^2$, where k is the spring rate of the valve spring, $y_0$ is the initial deflection amount of the valve spring, y is the deflection of the valve spring caused by the cam, or the valve lift, and M is the inertia mass.

As long as the load F is positive, the tappet follows the cam without the cam nose separating from the tappet. In the case of this embodiment, as seen from FIG. 6, the absolute value of the negative jerk in the vicinity of the maximum lift is small. The load F acting between the cam nose and the lifter in the vicinity of the maximum lift is greater by ΔF than the load F' with the conventional prior art type of cam profile. That is, the absolute value of the jerk y" which becomes negative in the vicinity of the maximum valve lift $y_{max}$ is kept small so that even at the maximum engine revolution where the camshaft rotation speed ω reaches the maximum value, $F=k(y_{max}+y_o)+M\times y''\times\omega_{max}^2>$ is satisfied. As a result, the follow-up behavior of the tappet to the cam nose is improved, operation is stabilized up to a high revolution, and the limit revolution (the engine revolution at which the force F becomes negative) may be increased.

Also, as may be seen in FIG. 7, the actual load between the cam nose and the lifter is increased in this range as indicated at the amount Δf as a result of the reduction in jerk. This is caused by the action of the spring on the valve.

Furthermore, as may be seen in FIG. 8, this increase causes a substantial decrease in the cam surface stress indicated at Δα in this figure. Thus, engine speed can be increased utilizing this concept and, at the same time, stress on the camshaft and wear is reduced.

Again, it has been assumed for the sake of discussion that the crankshaft and camshaft rotational speeds are constant.

The described embodiment and example deals with a direct activated valve wherein the cam lobes directly engage the tappets. As has been noted, however, the feature also can be utilized with rocker arm actuated valves, as shown in the embodiment of FIG. 2. In this instance, the curves illustrated can be considered to be representative of the curves dealing with the contact between the cam lobes and the tips of the rocker arms. The actual valve lift transmitted to the valve will, of course, be determined by the configuration of the rocker arms as those skilled in the art readily understand. However, the practical effects are the same and it is believed from the foregoing description that those skilled in the art can readily understand how the invention can be practiced in conjunction with either directly operated valves or valves that are operated via rocker arms or other types of intermediaries or followers.

As has been previously noted, the embodiment thus far described has assumed that the lift and duration of both the intake and exhaust camshafts is the same. The invention can also be practiced in conjunction with engines where this is not the case.

Figure 9:
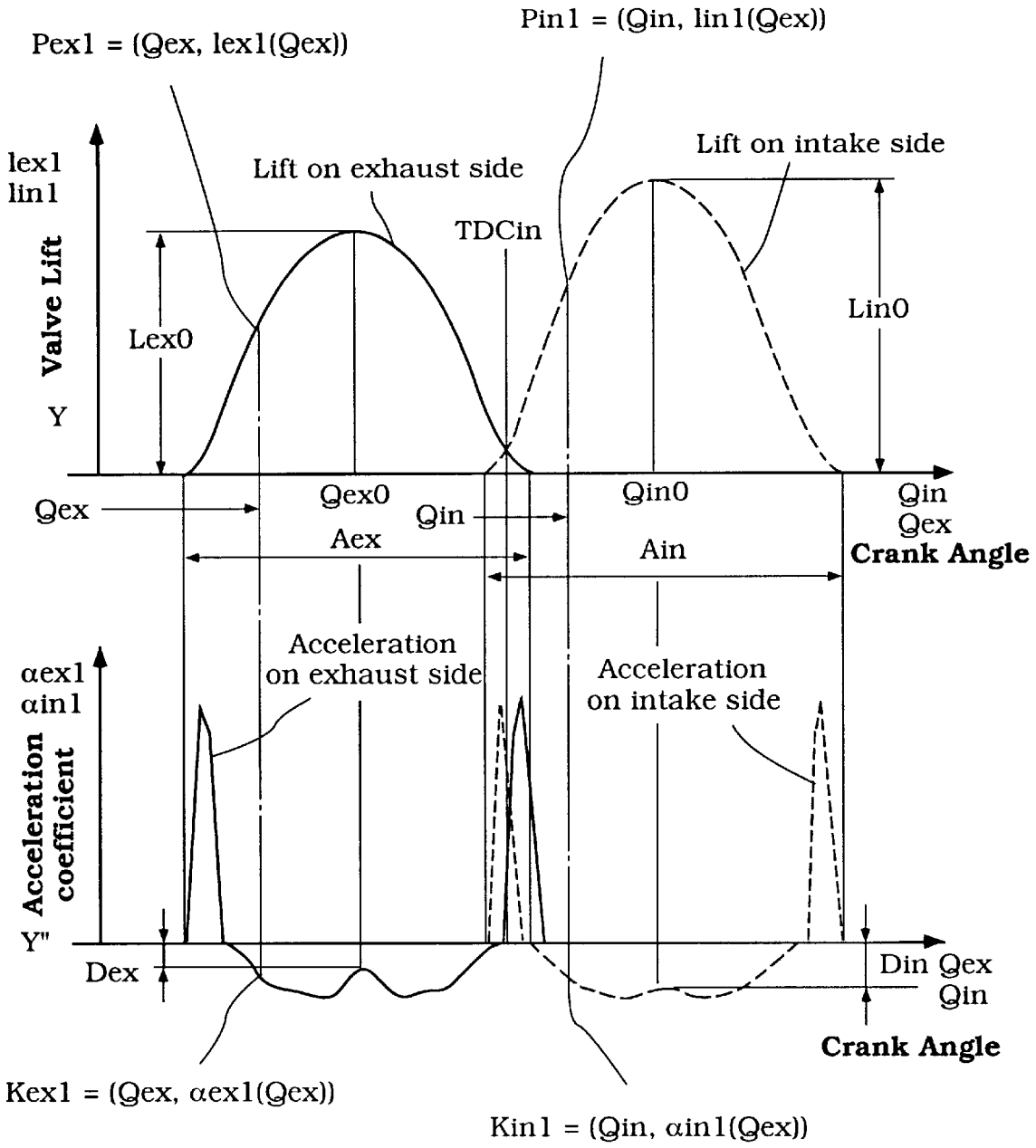
FIG. 9 is a graphical view showing the valve lift and valve jerk in accordance with one embodiment of valve timing and lift.

For example, FIG. 9 shows an embodiment wherein there is a greater lift of the intake camshaft than the exhaust camshaft. In connection with this situation, however, the time of opening of the intake and exhaust valves Ain and Aex are set to be substantially the same. With this arrangement, the amount of air inducted can be increased because of the greater valve lift. In the area where the radius of curvature of the camshaft lobes is made small at the maximum lift portion, however, the radius is increased at the maximum opening point from the conventional design as seen in these figures so as to reduce the jerk and accordingly improve the load between the cam lobe and the lifter and produce increased engine speed. Also, because of the stress formula, the actual cam lobe stress is reduced and durability is increased.

Figure 10:
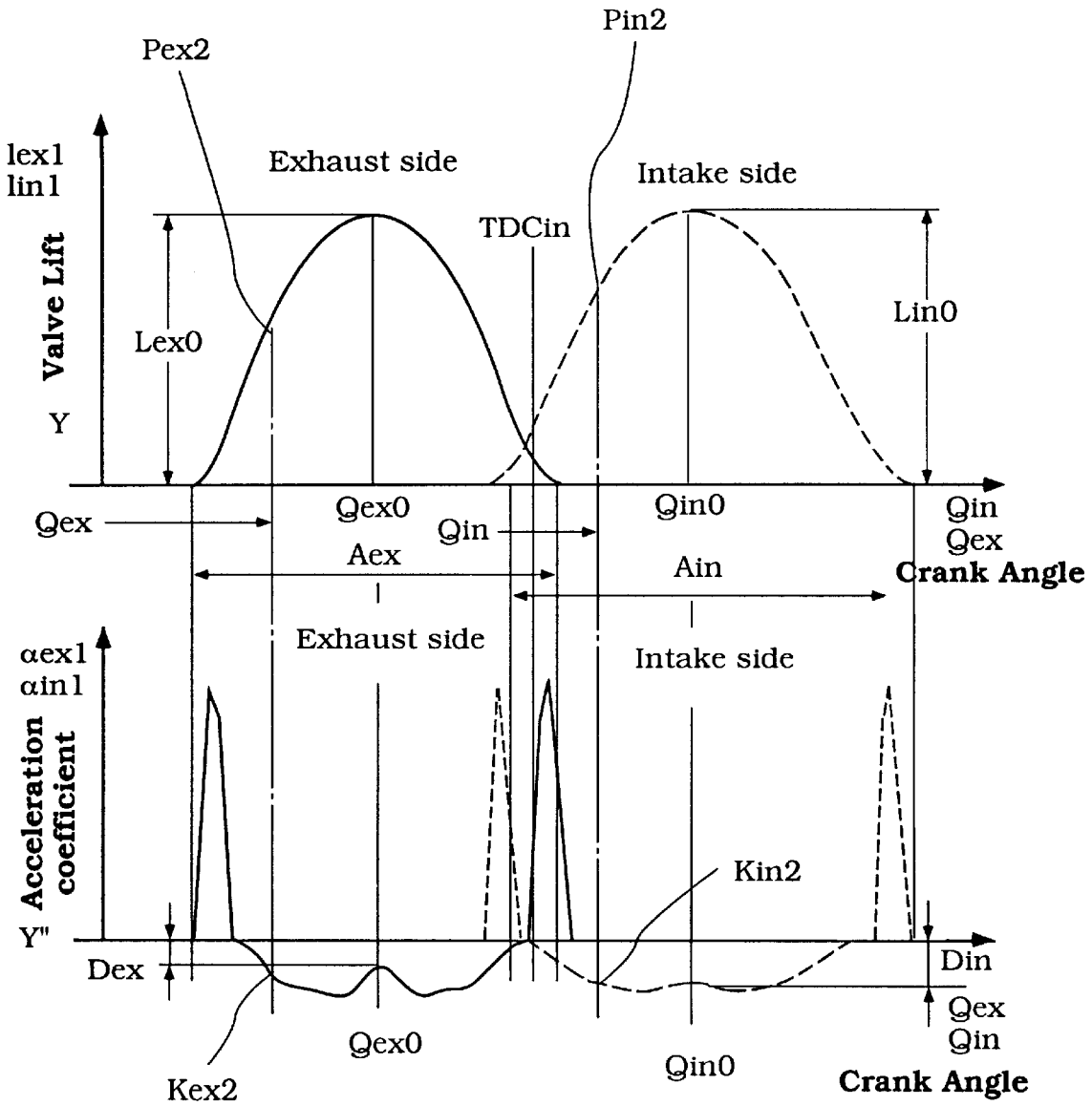
FIG. 10 is a graphical view, in part similar to FIG. 9, and shows another embodiment of the invention.

FIG. 10 shows another embodiment wherein the lifts for both the intake and the exhaust valves are maintained about the same. However, in this instance, the duration of opening of the intake valve Ain is made substantially greater than the opening of the exhaust valve Aex so as to improve air flow. Again, however, the radius of curvature at the maximum lift is made larger than the prior art type of constructions at the maximum lift point than adjacent it so as to reduce stress and increase loading.

Figure 11:
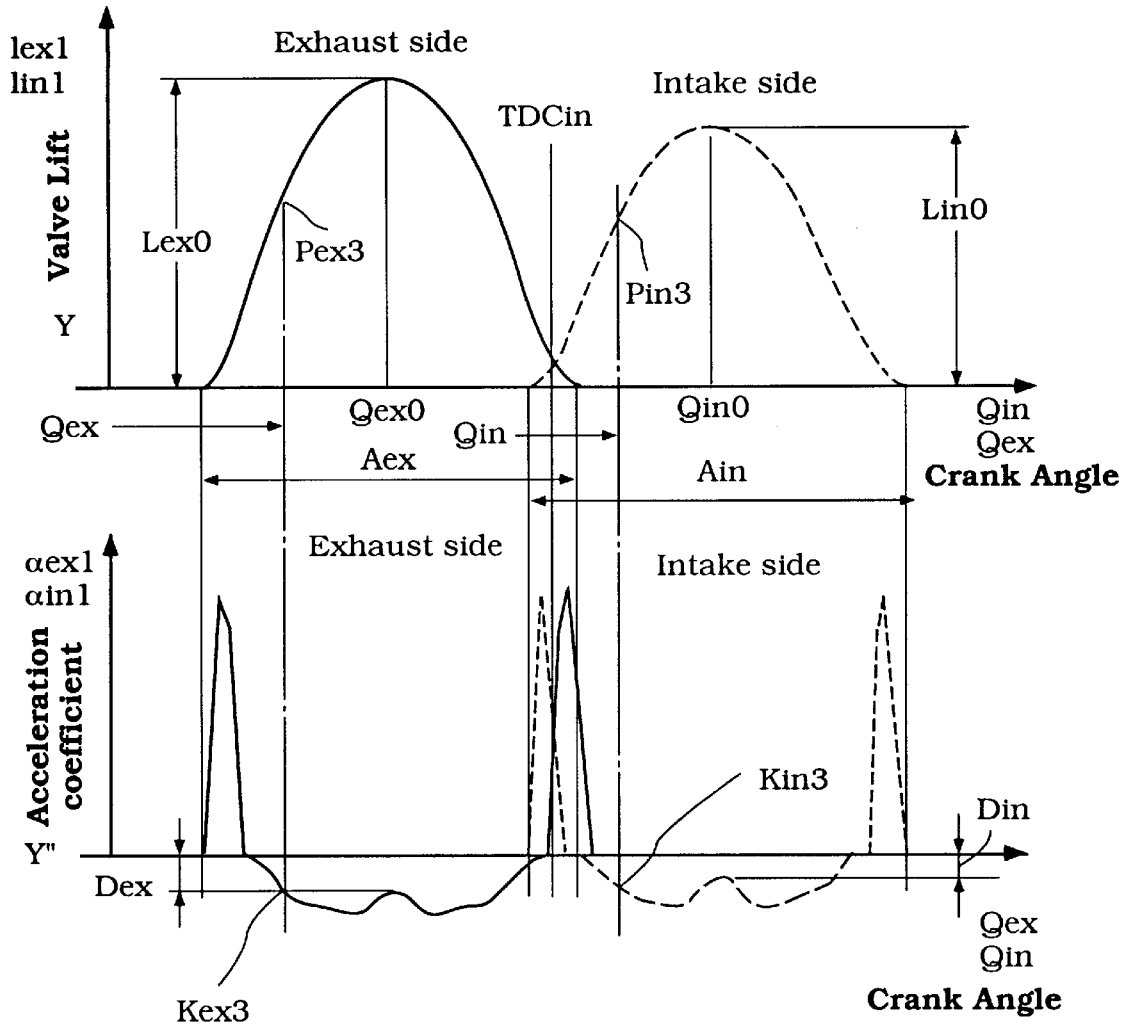
FIG. 11 is a graphical view, in part similar to FIGS. 9 and 10 and shows a third embodiment of the invention.

FIG. 11 shows another embodiment wherein the duration of opening of the exhaust and intake valves is maintained about the same, but in this case the lift for the exhaust valve is made greater. Again, however, the shape of curvature of the cam lobes at the lift portion is made larger than the adjacent smaller portions at the maximum lift area so as to reduce stress and increase loading force to avoid valve float.

Thus, from the foregoing description, it should be readily apparent that the described invention provides a camshaft configuration wherein valve performance can be substantially improved that permit attainment of higher engine speeds and greater durability because of the fact that the radius of curvature of the cam lobe at the maximum lift portion is made greater than that adjacent this maximum lift portion, rather than the same as with the prior art construction. Of course, the foregoing description is that of preferred embodiments of the invention and various changes and modifications may be made without departing from the spirit and scope of the invention, as defined by the appended claims.

What is claimed is:

1. A valve operating mechanism for operating a poppet valve of an internal combustion engine, said valve operating mechanism including a cam member rotating about a cam axis and having a cam lobe surface adapted to be engaged with a follower for actuating the poppet valve, the profile of said cam surface being such so that the cam lobe surface has an increasing radius at the beginning of its lift portion and then a decreasing radius up to a point prior to the point of maximum opening of the poppet valve and a greater effective radius at its tip where the valve has its maximum opening than on the sides adjacent said tip.

2. A valve operating mechanism as set forth in claim 1 wherein the cam has a heal portion in which no valve lift is effected and the cam lobe surface protrudes from said heal portion.

3. A valve operating mechanism as set forth in claim 2 wherein the radius of the tip of the cam lobe surface is less than that of the heal portion.

4. A valve operating mechanism as set forth in claim 1 wherein the profile of the cam surface is such so that a load between said cam lobe surface and the follower at the point of maximum valve opening is greater than a load during the time of at least one of the approach to maximum valve opening and the closing of the valve after the maximum valve opening.

5. A valve operating mechanism as set forth in claim 4 wherein the load between said cam lobe surface and the follower at the point of maximum lift is greater than the load during both the time of approach to maximum lift and the time of closing of the valve after the maximum lift.

6. A valve operating mechanism as set forth in claim 5 wherein the cam has a heal portion in which no valve lift is effected and the cam lobe surface protrudes from said heal portion.

7. A valve operating mechanism as set forth in claim 6 wherein the radius of the tip of the cam lobe surface is less than that of the heal portion.

8. A valve operating mechanism as set forth in claim 1 wherein the profile of the cam surface is such so that the absolute value of jerk of valve acceleration in the vicinity of maximum valve opening is smaller than absolute value of jerk of the valve acceleration in areas adjacent to the area of maximum valve opening.

9. A valve operating mechanism as set forth in claim 8 wherein the cam has a heal portion in which no valve lift is effected and the cam lobe surface protrudes from said heal portion.

10. A valve operating mechanism as set forth in claim 9 wherein the radius of the tip of the cam lobe surface is less than that of the heal portion.

* * * * *